US007331908B2

(12) United States Patent
Olsen

(10) Patent No.: US 7,331,908 B2
(45) Date of Patent: Feb. 19, 2008

(54) MULTI-FUNCTION WEIGHT TRAINING APPARATUS

(75) Inventor: Brian Olsen, Cold Spring, MN (US)

(73) Assignee: Extreme Degree Fitness, Inc., Cold Spring, MN (US)

( * ) Notice: Subject to any disclaimer, the term of this patent is extended or adjusted under 35 U.S.C. 154(b) by 307 days.

(21) Appl. No.: 10/104,539

(22) Filed: Mar. 22, 2002

(65) Prior Publication Data

US 2002/0137605 A1 Sep. 26, 2002

Related U.S. Application Data

(60) Provisional application No. 60/278,559, filed on Mar. 23, 2001.

(51) Int. Cl.
*A63B 21/062* (2006.01)
*A63B 71/00* (2006.01)

(52) U.S. Cl. ..... 482/99; 482/101; 482/139

(58) Field of Classification Search ..... 482/92–94, 482/96, 98–104, 137–139, 908, 71–72, 144
See application file for complete search history.

(56) References Cited

U.S. PATENT DOCUMENTS

| | | | | | |
|---|---|---|---|---|---|
| 2,783,045 | A | * | 2/1957 | Bosch | 482/96 |
| 3,870,297 | A | * | 3/1975 | Elder | 482/7 |
| 3,905,599 | A | | 9/1975 | Mazman | 272/81 |
| 3,912,263 | A | | 10/1975 | Yatso | 272/81 |
| 4,286,782 | A | | 9/1981 | Fuhrhop | 272/117 |
| 4,700,944 | A | | 10/1987 | Sterba et al. | 272/117 |
| 4,720,103 | A | * | 1/1988 | Palladino, Jr. | 473/438 |
| 4,763,897 | A | | 8/1988 | Yakata | 272/118 |
| 4,930,769 | A | * | 6/1990 | Nenoff | 482/96 |
| 5,254,066 | A | * | 10/1993 | Brown et al. | 482/137 |
| 5,263,913 | A | * | 11/1993 | Boren | 482/96 |
| 5,354,251 | A | * | 10/1994 | Sleamaker | 482/96 |
| 5,383,831 | A | * | 1/1995 | Drath | 482/101 |
| 5,503,609 | A | * | 4/1996 | Bull | 482/70 |
| 5,752,879 | A | * | 5/1998 | Berdut | 482/96 |
| 5,800,321 | A | | 9/1998 | Webber | 482/103 |
| 5,885,197 | A | * | 3/1999 | Barton | 482/144 |
| 6,015,369 | A | | 1/2000 | Rasmussen | 482/96 |
| 6,074,328 | A | * | 6/2000 | Johnson | 482/97 |
| 6,634,996 | B2 | * | 10/2003 | Jacobsen | 482/96 |

* cited by examiner

*Primary Examiner*—Fenn C. Mathew
(74) *Attorney, Agent, or Firm*—Knobbe, Martens, Olson & Bear, LLP

(57) ABSTRACT

A multi-function weight training apparatus including a support base, a linear motion beam, a resistance adjusting carriage, a main carriage, a weight carriage and a cable. The linear motion beam is rotatably mounted to the base. The resistance adjusting carriage is mounted to the linear motion beam, wherein the resistance adjusting carriage is selectively positionable on the linear motion beam. The main carriage is mounted to the linear motion beam. The weight carriage is mounted with respect to the support base. The cable operably connects the weight carriage to the main carriage while an intermediate portion of the cable engages the resistance adjusting carriage. Moving the main carriage with respect to the linear motion beam causes the weight carriage to move with respect to the support base.

25 Claims, 22 Drawing Sheets

MULTI-FUNCTION WEIGHT TRAINING APPARATUS

REFERENCE TO RELATED APPLICATION

This application claims priority to U.S. Provisional Application Ser. No. 60/278,559 filed Mar. 23, 2001.

FIELD OF THE INVENTION

The present invention relates generally to a weight training apparatus. More particularly, the present invention relates to a multi-function weight training apparatus that is adapted for use with a variety of weight training exercises.

BACKGROUND OF THE INVENTION

The general concept of using an apparatus to facilitate weight training such as disclosed in Mazman, U.S. Pat. No. 3,905,599, and Yatso, U.S. Pat. No. 3,912,263, has been known for a significant amount of time. These types of devices enhance the ability to perform the weight training exercises but also increase the safety of performing the weight training exercises.

Fuhrhop, U.S. Pat. No. 4,286,782, discloses an adjustable exercise device that permits the configuration of different components to be changed to facilitate performing different exercises. The Fuhrhop device includes a series of holes along the posts that permit attachment at different locations on the posts. Similarly, Sterba et al., U.S. Pat. No. 4,700,944, and Rasmussen, U.S. Pat. No. 6,015,369, each disclose a weight training system in which components are connected in different positions to facilitate performing different exercises.

Yakata, U.S. Pat. No. 4,763,897, discloses an exercise device that includes a support platform and a pivot lever. The pivot lever is slidable with respect to the support platform. It is also possible to adjust the initial angular orientation of the pivot lever and a distance between the support platform and an end of the pivot lever opposite the support platform. Rotation of the pivot lever causes a weight stack to be lifted.

Webber, U.S. Pat. No. 5,800,321, describes an exercise apparatus a pivotally mounted linkage mechanism. Pivoting of the linkage mechanism with respect to a support frame adjusts a height of linkage mechanism to facilitate performing a variety of exercises with the exercise apparatus.

SUMMARY OF THE INVENTION

The present invention relates to a multi-function weight training apparatus. The multi-function weight training apparatus includes a support base and a linear motion beam. The linear motion beam is rotatably mounted to the support base to change the angular orientation and the direction of forces that can be exerted on the multi-function weight training apparatus for performing a variety of weight training exercises with the multi-function weight training apparatus.

DETAILED DESCRIPTION OF THE PREFERRED EMBODIMENT

Figure 1:
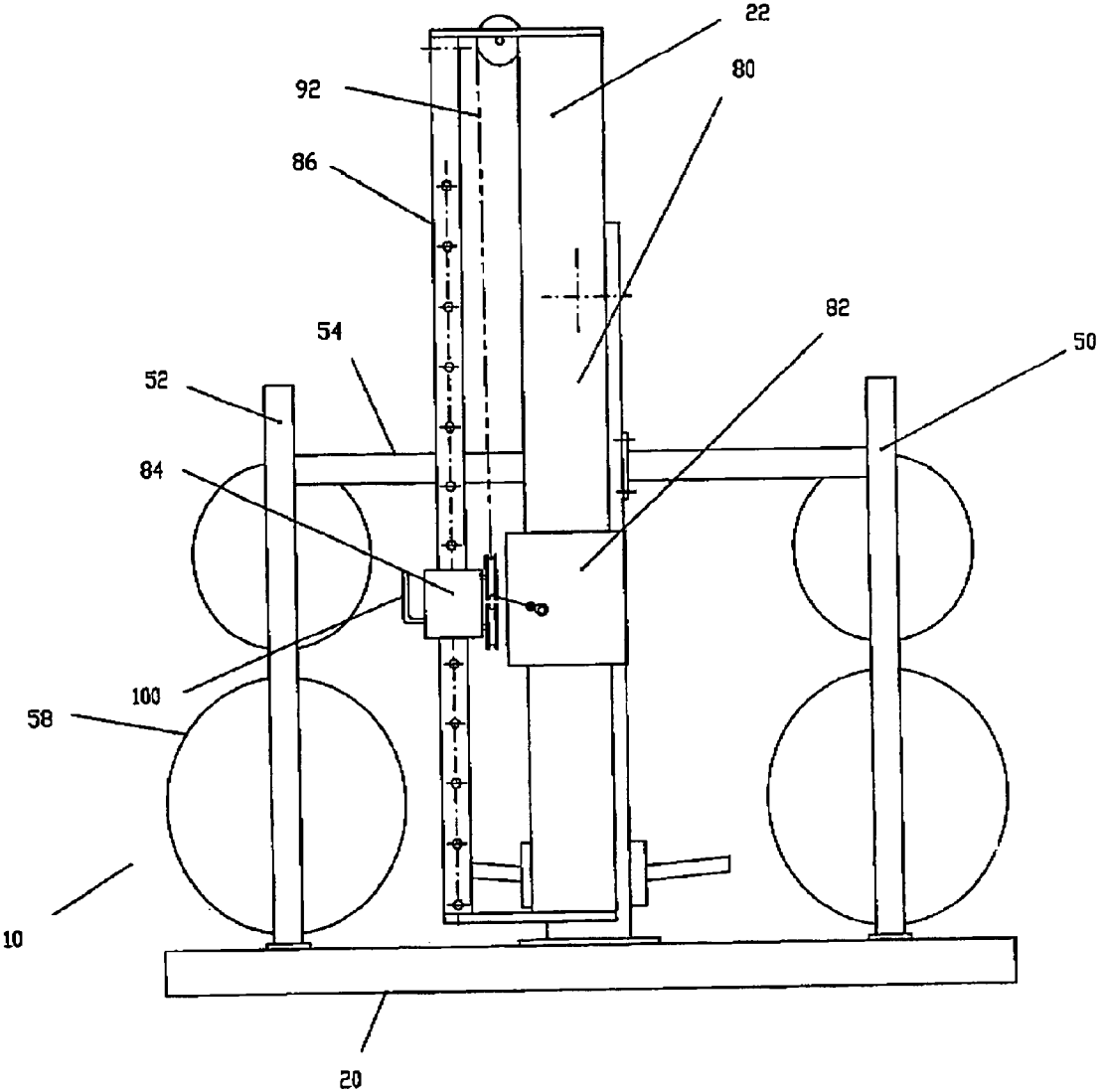
FIG. 1 is a front view of a multi-function weight training apparatus of the present invention.
Figure 2:
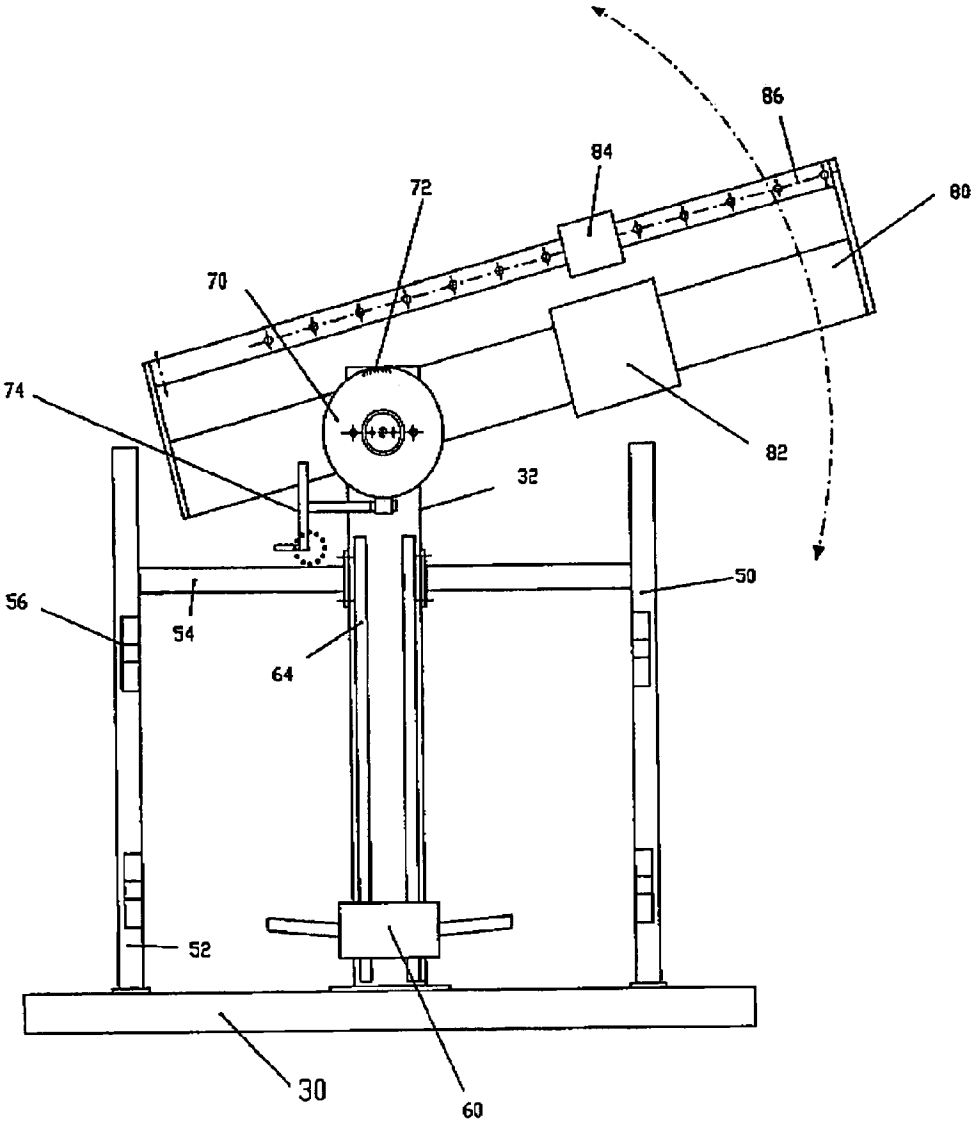
FIG. 2 is a back view of the multi-function weight training apparatus.

A multi-function weight training apparatus according to the present invention is most clearly illustrated at 10 in FIGS. 1 and 2. The multi-function weight training apparatus 10 generally includes a support base 20 and a linear motion beam 22 that is rotatably mounted with respect to the support base 20.

Rotating the linear motion beam 22 with respect to the support base 20 permits a variety of weight training exercises to be performed with the multi-function weight training apparatus 10. The multi-function weight training apparatus 10 thereby reduces the number of weight training apparatuses that must be purchased to perform a large variety of weight training exercises.

Figure 3:
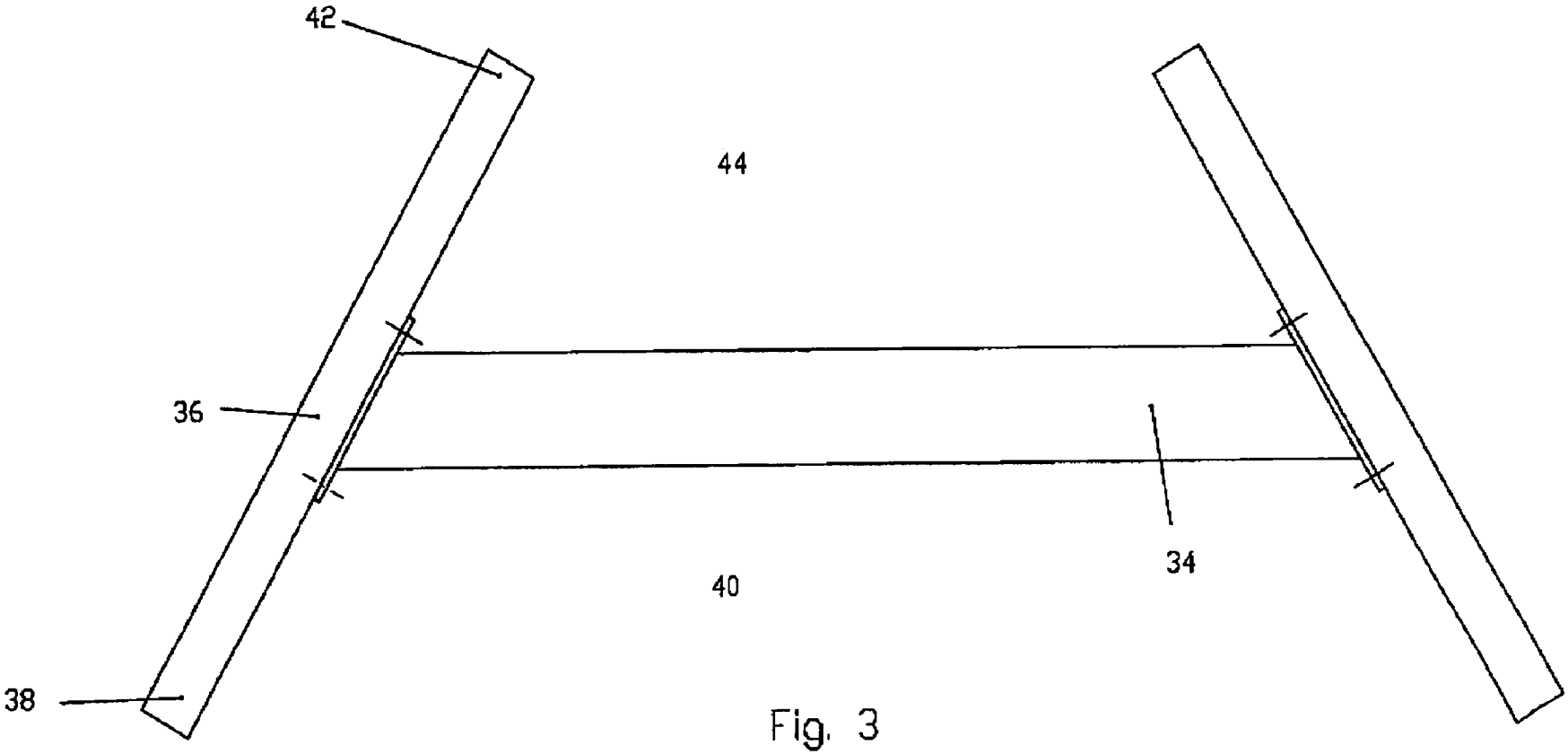
FIG. 3 is a top view of a base portion of the multi-function weight training apparatus.

The support base 20 generally includes a bottom section 30 and a main post 32 that extends from the bottom section 30. The bottom section 30 stabilizes the multi-function weight training apparatus 10 such that the multi-function weight training apparatus 10 maintains a desired orientation on a ground surface during use. The bottom section 30 generally includes a central member 34 and a pair of end members 36 that are mounted at opposite ends of the central member 34, as illustrated in FIG. 3.

The end members 36 are preferably oriented at an angle with respect to the central member 34 so that a distance between front ends 38 of the end members 36 on a front side 40 of the multi-function exercise device 10 is greater than a distance between back ends 42 of the end members 36 on a back side 44 of the multi-function exercise device 10. An angle a between the central member 34 and each of the end members 36 is greater than about 90 degrees, preferably between about 110 and 130 degrees and most preferably about 120 degrees.

Attaching the end members 36 to the central member 34 in this configuration enhances the stability of the multi-function exercise device 10 while minimizing the potential for the end members 36 interfering with a person who is using the multi-function exercise device 10.

The main post 32 extends in a substantially vertical direction from the central member 34, as illustrated in FIGS. 1 and 2. The linear motion beam 22 is attached to the vertical section 32 opposite the central member 34. To stabilize the vertical section 32, the multi-function exercise device 10 preferably includes a pair of outriggers 50. Each of the outriggers 50 includes a vertical portion 52 and a horizontal portion 54. The vertical portions 52 are attached to the central member 34 proximate the end members 36. The horizontal portions 54 are attached to the vertical portion 52 and the main post 32. In addition to stabilizing the multi-function exercise device 10, the vertical portions 52 are also adapted to receive weight holders 56 for storing weight plates 58 when the weight plates are not in use.

Figure 4:
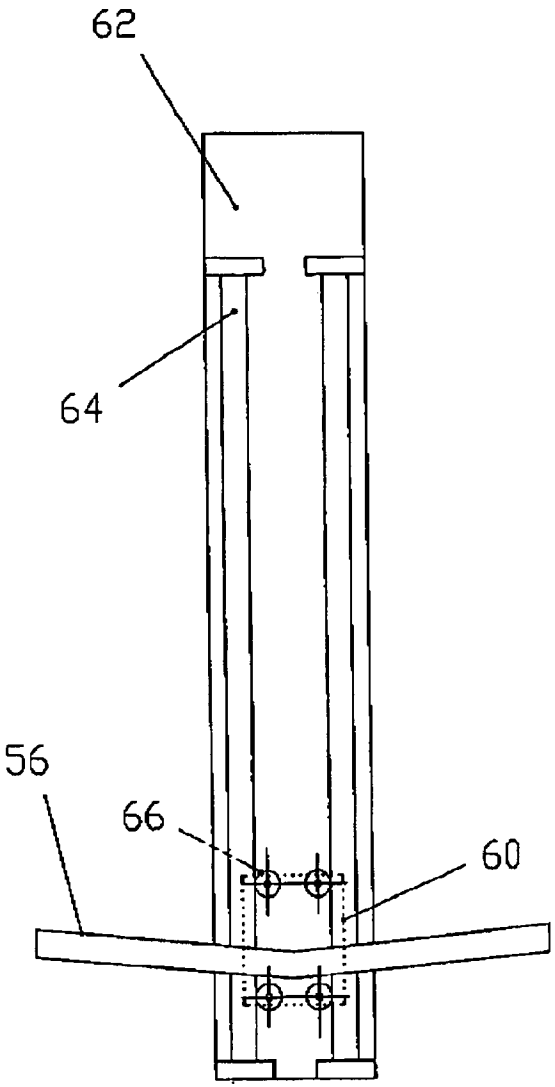
FIG. 4 is an illustration of a weight carriage of the multi-function weight training apparatus.

A weight carriage 60 is slidably mounted to a weight support post 62 that extends in a substantially vertical direction form the bottom section 30, as illustrated in FIG. 4. The weight support post 62 is preferably oriented substantially parallel to the main post 32. Mounting of the weight carriage 60 to the weight support post 62 is preferably accomplished with a pair of shafts 64. Each of the shafts 64 preferably has a diameter of approximately 1 inch. The weight carriage 60 has at least one post 56 that is adapted to receive weight plates 58. A person of ordinary skill in the art will appreciate that it is possible to use the concepts of the present invention with alternative types of weight carriage as well as weights where the resistance is generating by bending objects, such as is used in the BOWFLEX exercise device, by stretching objects such as bungee cords, hydraulic fluids or compressed gases.

The weight carriage 60 preferably includes two rollers 66 and most preferably four rollers 66 rotatably mounted thereto, as illustrated in FIG. 4. The rollers 66 preferably have a concaved outer surface 68 that at least partially conforms to the shafts 64. When four rollers 66 are used, there are two upper rollers 66 and two lower rollers 66.

The linear motion beam 22 provides the ability to place the resistance anywhere along the linear motion beam 22 and provides the ability to use the resistance in a push or pull motion. The linear motion beam 22 preferably has a length of less than about 10 feet and more preferably approximately 5 feet.

Figure 5:
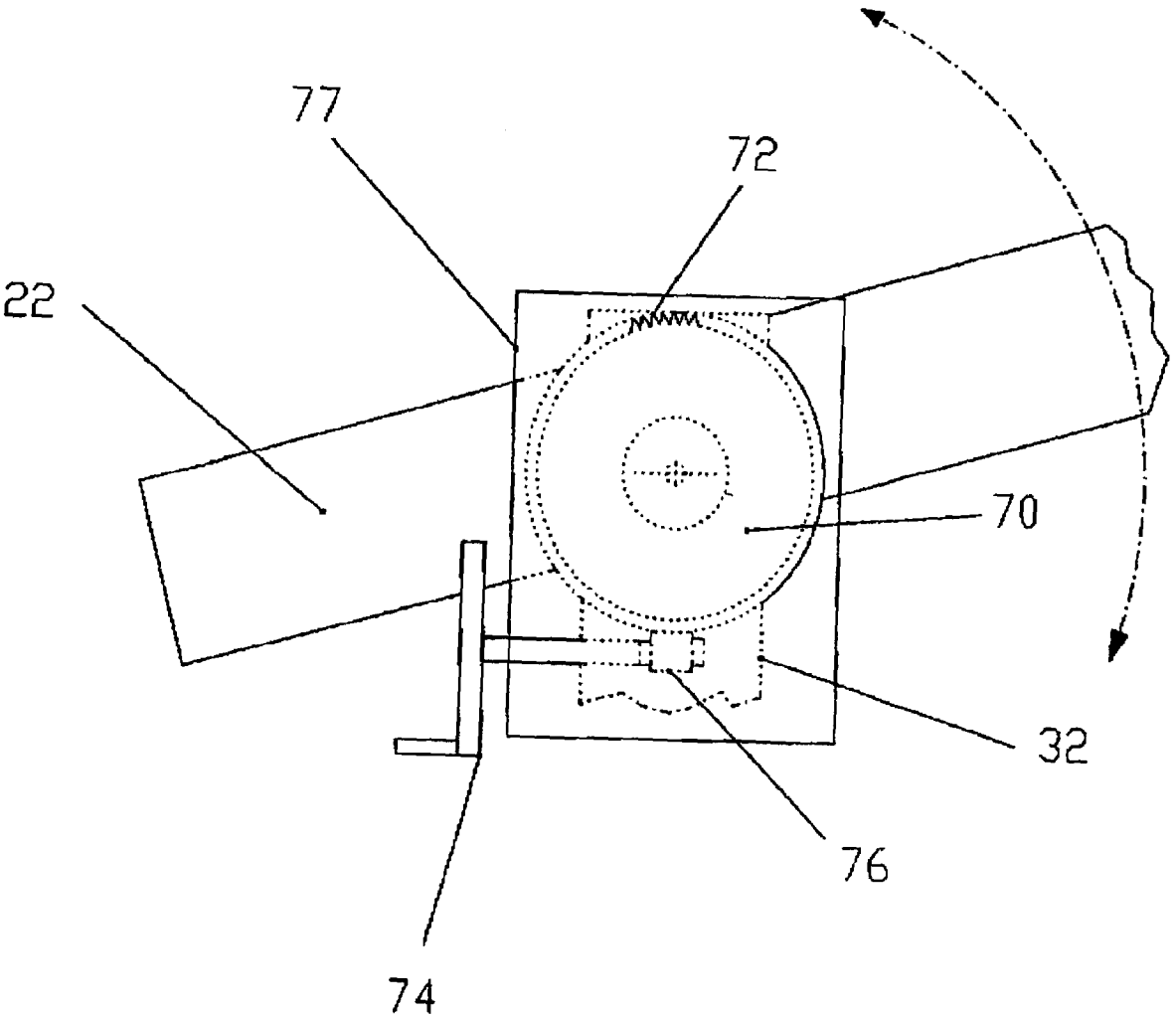
FIG. 5 is an illustration of a worm gear drive of the multi-function weight training apparatus.

Rotation of the linear motion beam 22 is preferably controlled by a worm gear drive 70 that is attached to the linear motion beam 22, as illustrated in FIG. 5. The worm gear drive 70 includes a plurality of teeth 72 around an outer surface thereof. A hand crank wheel 74 is rotatably mounted to the main post 32 so that a screw 76 on the hand crank wheel 74 engages the teeth 72. Rotation of the hand crank wheel 74 thereby causes the linear motion beam 22 to rotate with respect to the main post 32.

Rotation of the linear motion beam 22 can also be controlled by a pop-pin mechanism where the worm gear drive 70 has a series of apertures (not shown) formed therein and a pin (not shown) is provided on the main post 32 to seat in the apertures.

A cover 77 is preferably placed over a significant portion of the worm gear drive 70, as illustrated in FIG. 5. The cover 77 protects the components of the gear drive 70 and enhances the aesthetic appearance of the multi-function exercise device 10.

The linear motion beam 22 has a main section 80 along which a main carriage 82 is slidable, as illustrated in FIG. 1. The linear motion beam 22 also has a resistance adjusting carriage 84 that is slidably mounted to a secondary post 86 that is mounted substantially parallel to the main section 80.

While the main section 80 and the secondary post 86 are both illustrated as having a substantially square profile, a person of ordinary skill in the art will appreciate that other configurations may be used with the concepts of the present invention such as an I-beam shape or cylindrical shafts.

Figures 6A, 6B:
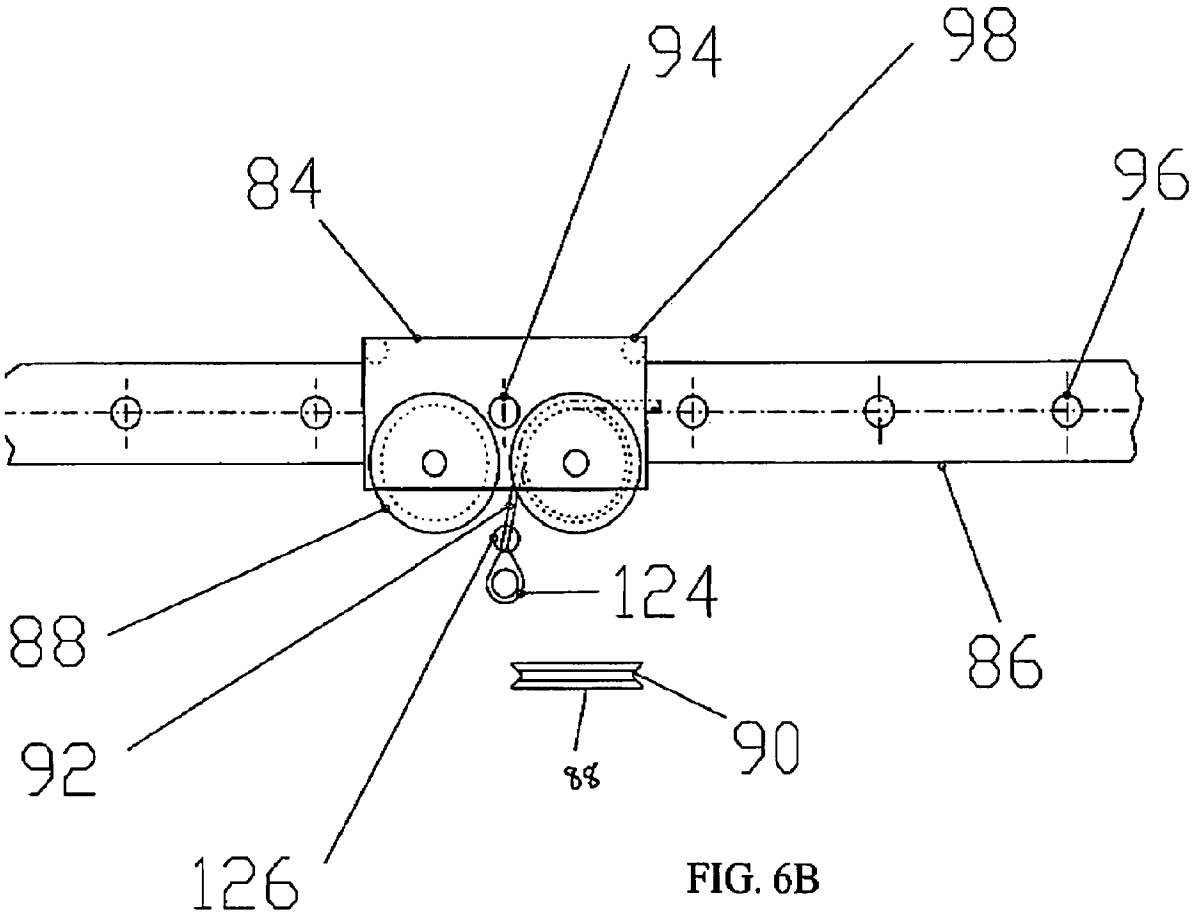
FIG. 6*a* is an illustration of a resistance adjusting carriage of the multi-function weight training apparatus.
FIG. 6*b* is a side view of a pulley of the resistance adjusting carriage of FIG. 6*a*.

The resistance adjusting carriage 84 has a pair of pulleys 88 that are rotatably mounted thereto, as illustrated in FIG. 6*a*. The pulleys 88 each have a channel 90 formed in an outer surface thereof. The channels 90 are adapted to at least partially receive a cable 92.

Depending upon the location of the rotational axis on the linear motion beam 22, the linear motion beam 22 may be a counter weight (not shown) mounted therein so that the linear motion beam 22 is balanced about its rotational axis. While it is possible to configure the linear motion beam 22 with the rotational axis proximate one end of the linear motion beam 22, this configuration would preclude having the linear motion beam 22 balanced about its rotational axis.

The resistance adjusting carriage 84 preferably has a substantially square profile that extends around the secondary post 86. The resistance adjusting carriage 84 has a pin 94 removably attached thereto. The pin 94 is adapted to seat in apertures 96 along the secondary post 86. Engaging the pin 94 in one of the aperture 96 thereby retains the resistance adjusting carriage 84 in a desired fixed position with respect to the secondary post 86.

The resistance adjusting carriage 84 may also include at least one cylindrical roller 98 rotatably mounted therein, as illustrated in FIGS. 6*a* and 6*b*. Preferably, the resistance adjusting carriage 84 includes one of the cylindrical roller 98 along each side thereof proximate each end of the resistance adjusting carriage 84. The cylindrical rollers 98 are preferably fabricated from a low friction material such TEFLON. As the resistance adjusting carriage 84 is moved with respect to the secondary post 86, the cylindrical roller 98 rolls along the secondary post 86 to thereby provide a smooth motion.

To facilitate moving the resistance adjusting carriage 84 with respect to the secondary shaft 86, the resistance adjusting carriage 84 preferably has a handle 100 attached thereto.

Figure 7:
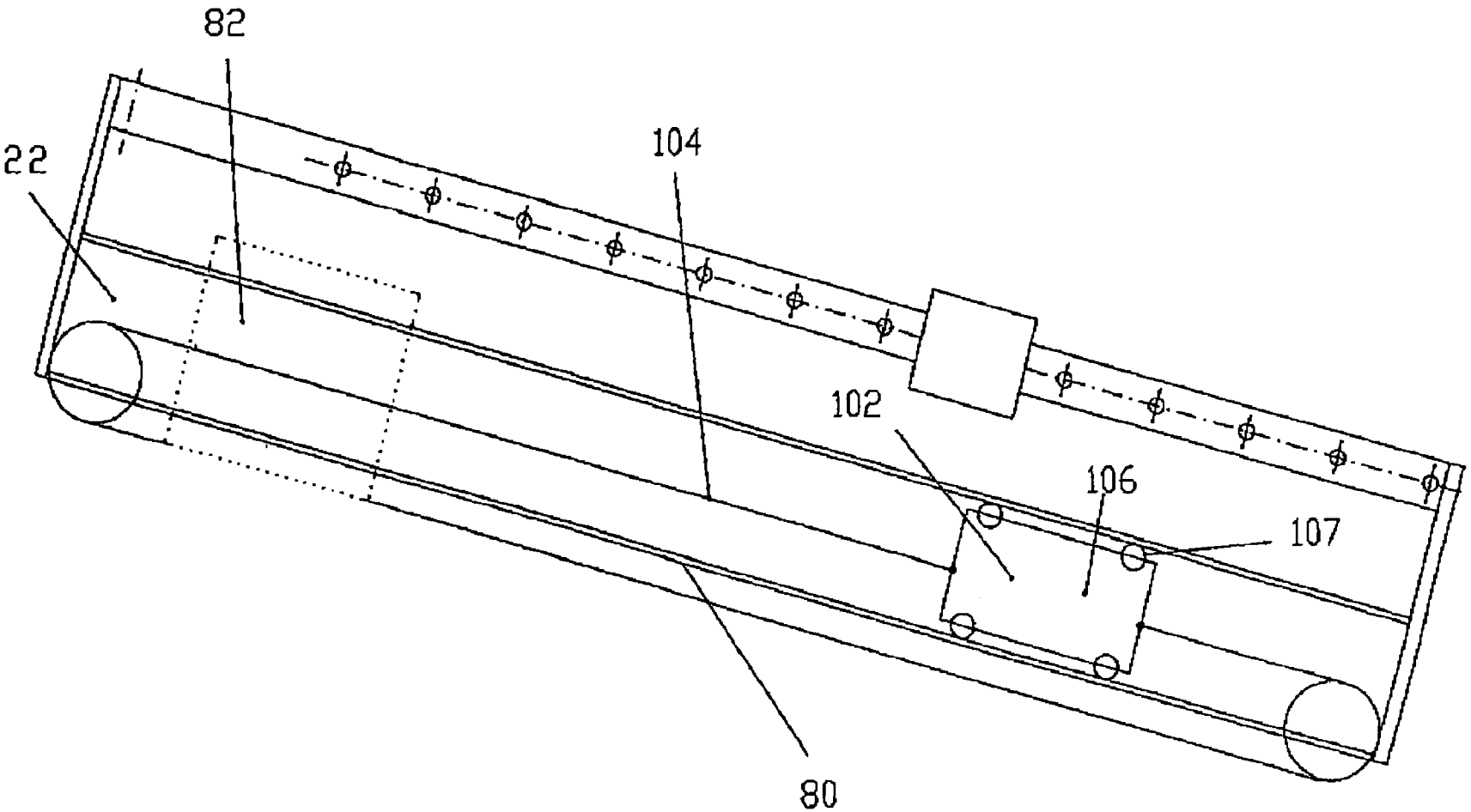
FIG. 7 is a sectional view of linear motion beam of the multi-function weight training apparatus.
Figure 9:
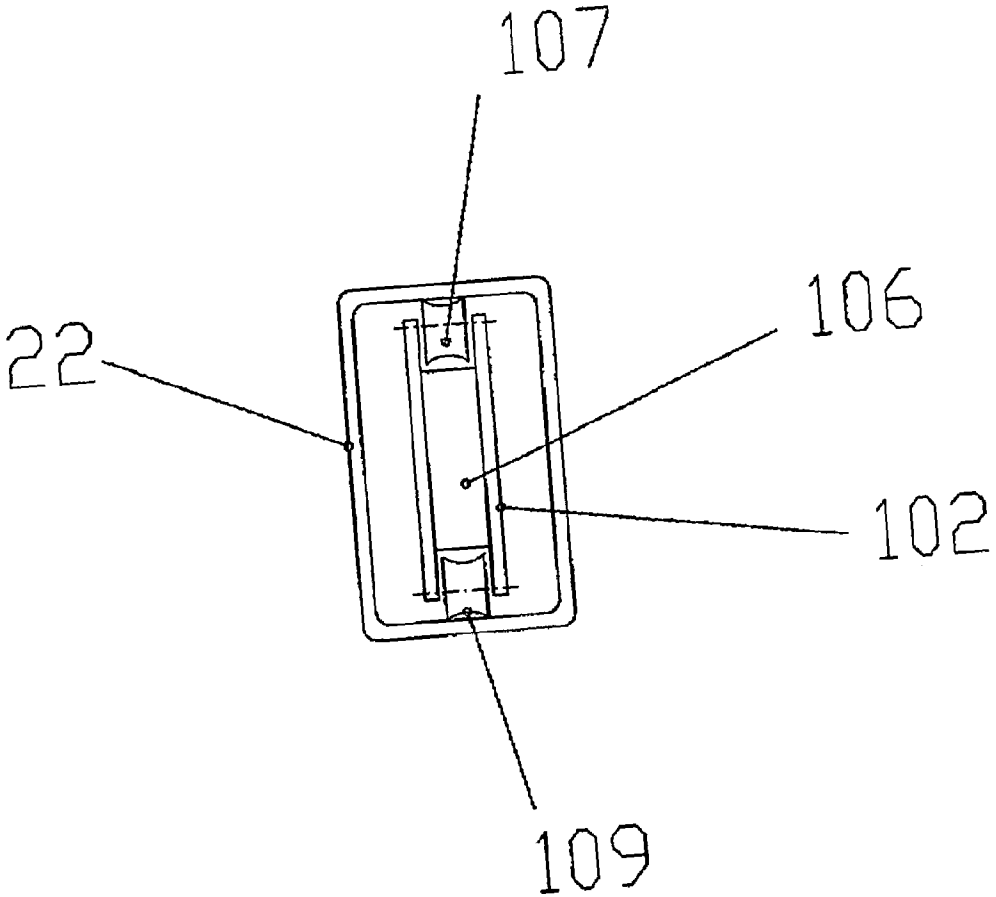
FIG. 9 is a sectional view of the linear motion beam

The linear motion beam 22 also preferably includes a counter weight 102 mounted therein, as illustrated in FIGS. 7 and 9. Using the counter weight 102 with the linear motion beam 22 offsets the weight of the main carriage 82. Using the counter weight 102 enables the linear motion beam to remain balanced about its rotational axis as the main carriage 82 is moved on the linear motion beam. The counter weight 102 is preferably attached to the main carriage 82 with a strong and flexible material such as a KEVLAR belt 104 or a nylon coated cable.

Figure 8:
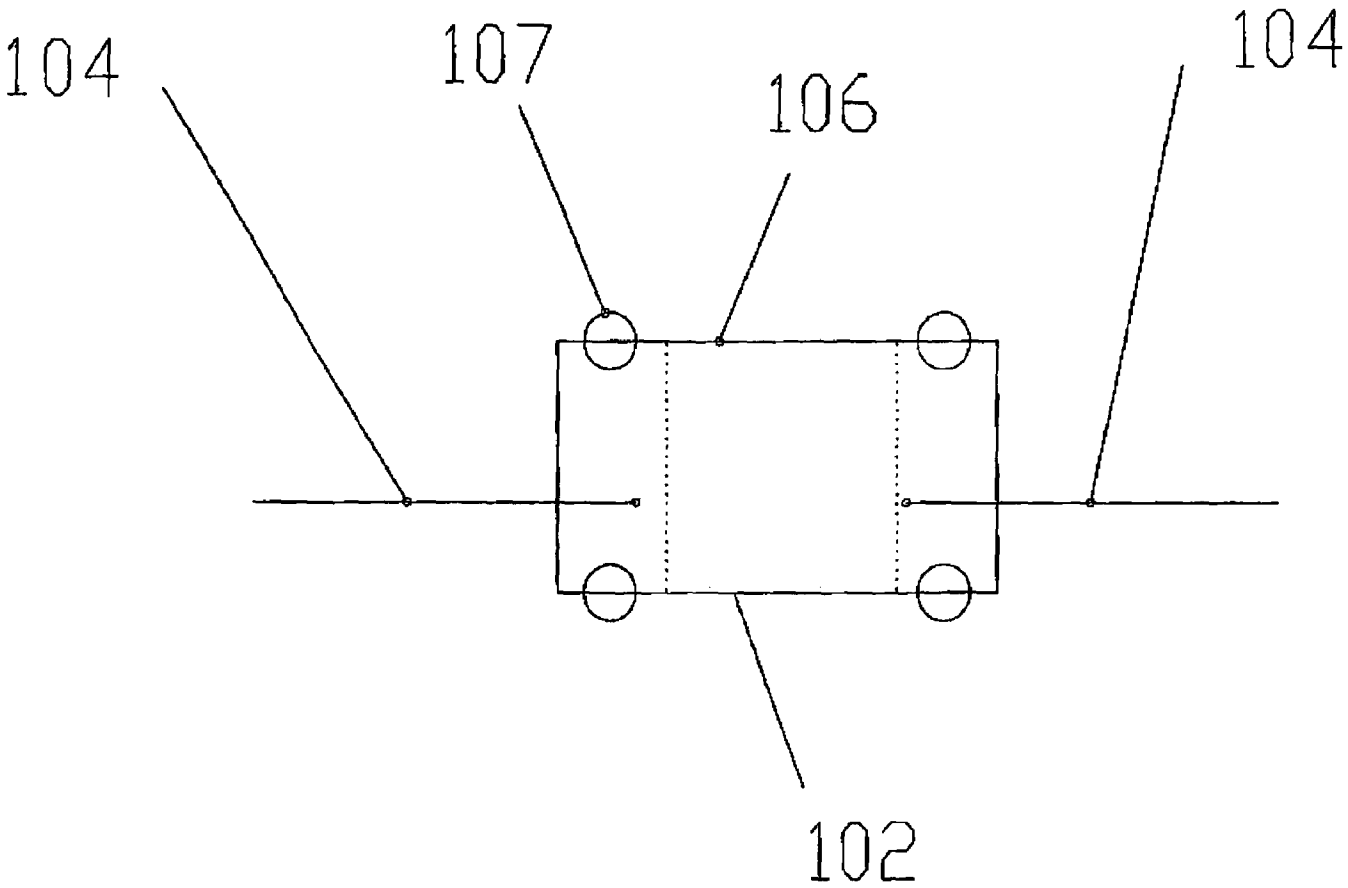
FIG. 8 is a side view of a counter weight of the linear motion beam.

The counter weight 102 includes a main section 106 and a pair of wheels 107 mounted on opposite ends of the main sections 106 so that the wheels 107 extend above a surface of the main section 106 as illustrated in FIGS. 7 and 8. The wheels 107 preferably have a concave outer surface 108. The linear motion beam 22 includes two tracks 109 mounted therein. The concave outer surface 108 of the wheels 107 is adapted to at least partially receive the track 109 so that the counter weight 102 can roll along the track. The wheels 107 are preferably fabricated from a urethane material.

Figure 10:
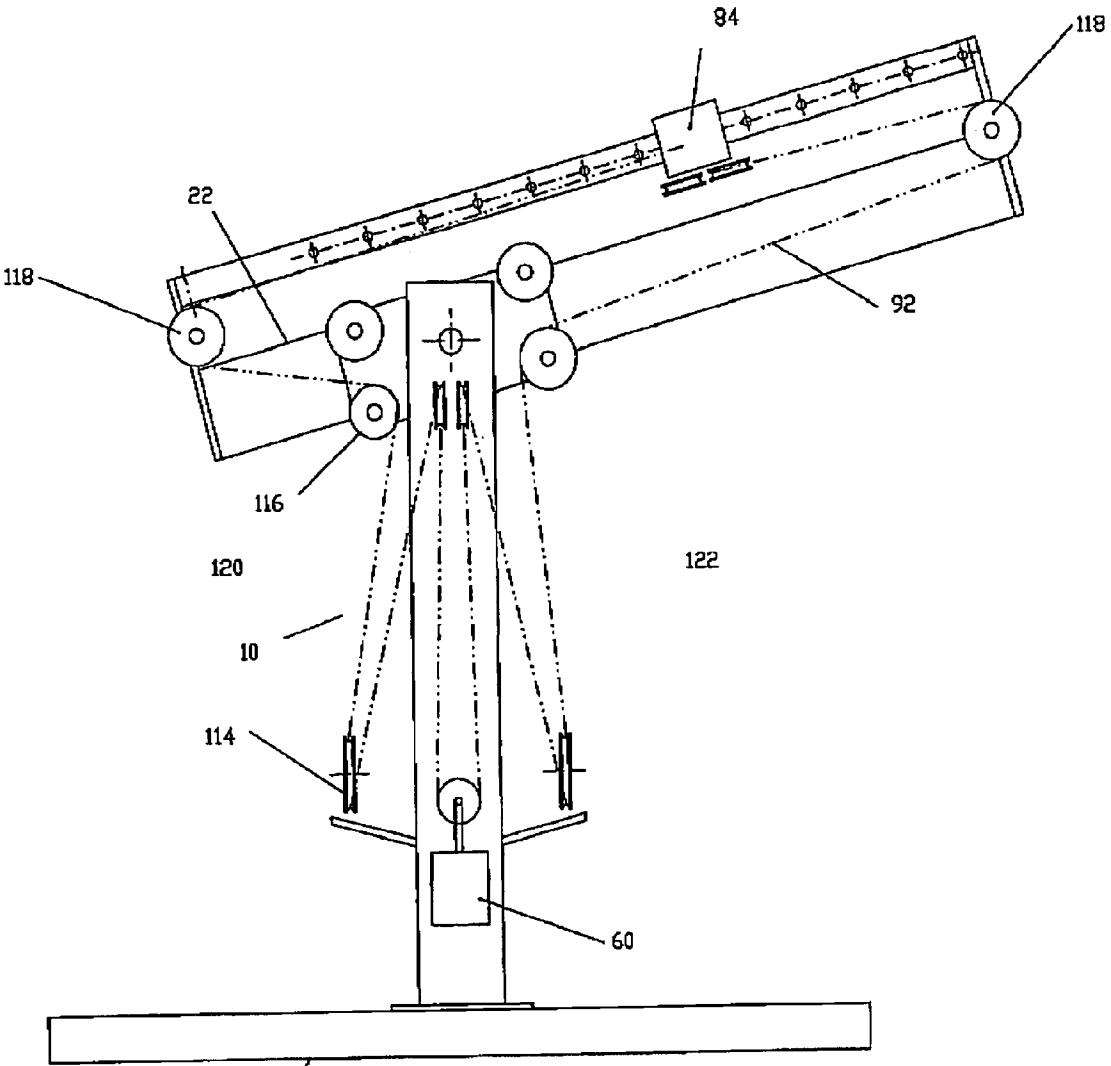
FIG. 10 is a back view of the linear motion beam attached to a base.
Figure 11:
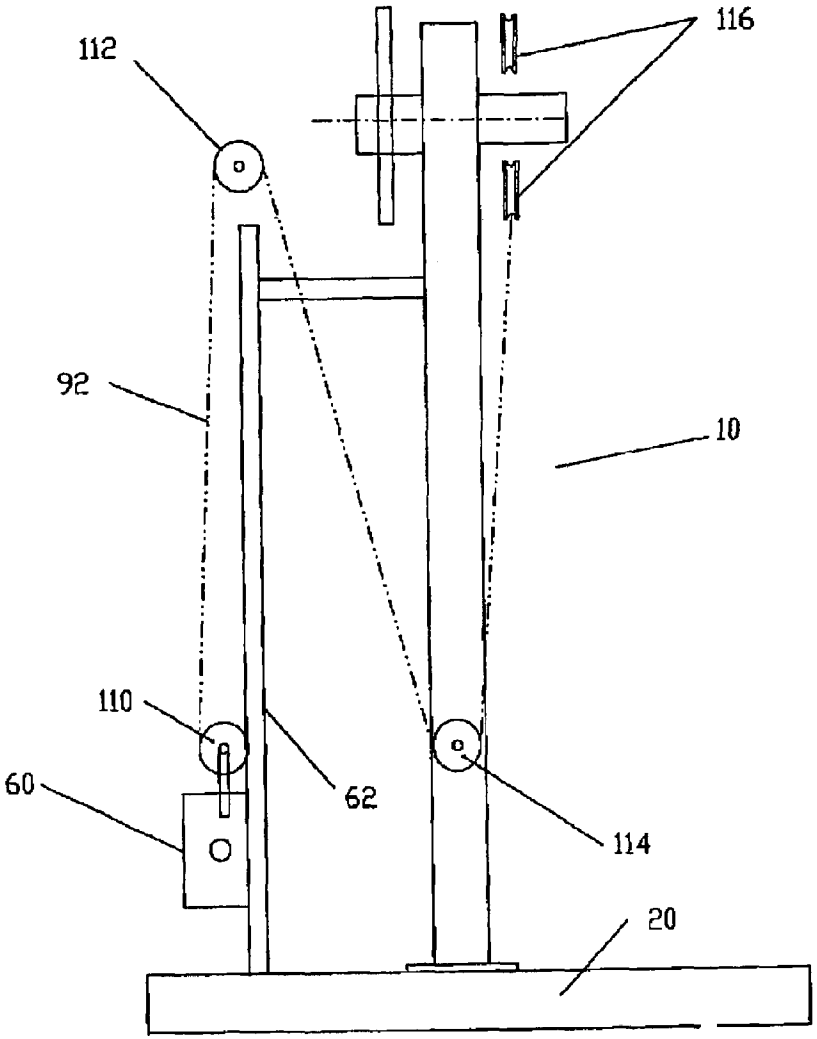
FIG. 11 is a side view illustration of a cable path in the multi-function weight training apparatus.

The cable 92 is attached to the components of the multi-function weight training apparatus 10 through a series of pulleys. The series of pulleys permit the cable 92 to be easily adjusted when moving the locations of the main carriage 82 and the resistance adjusting carriage 84. In particular, the series of pulleys includes a first pulley 110 mounted with respect to the weight carriage 60. The series of pulleys also includes a pair of second pulleys 112 mounted at an upper end of the weight stack support post 62 as illustrated in FIGS. 10 and 11. A pair of third pulleys 114 is mounted on opposite sides of the main post 32. A pair of fourth pulleys 116 is attached to the linear motion beam 22 proximate the intersection of the linear motion beam 22 and the main post 32. A pair of fifth pulleys 118 is mounted at opposite ends of the linear motion beam 22.

A first pulley of the pair of the second, third, fourth and fifth pulleys 112, 114, 116, 118 defines a first cable path 120. A second pulley of the pair of second, third, fourth, and fifth pulleys 112, 114, 116, 118 defines a second cable path 112. The first cable path 120 and the second cable path 122 intersect proximate the first pulley 110. Opposite the first pulley 110, the first cable path 120 terminates at the resistance adjusting carriage 84. Opposite the first pulley 110, the second cable path 122 terminates at a loop 124 that extends between the pair of rollers 88 as illustrated in FIG. 6*a*. To prevent the loop 124 from passing between the pair of rollers 88, a ball 126 is attached to the cable 92 proximate the loop 124.

The loop 124 provides a mechanism to removably and operably attach the weight carriage 60 to the main carriage 82 for performing the weight training exercises.

Figure 12:
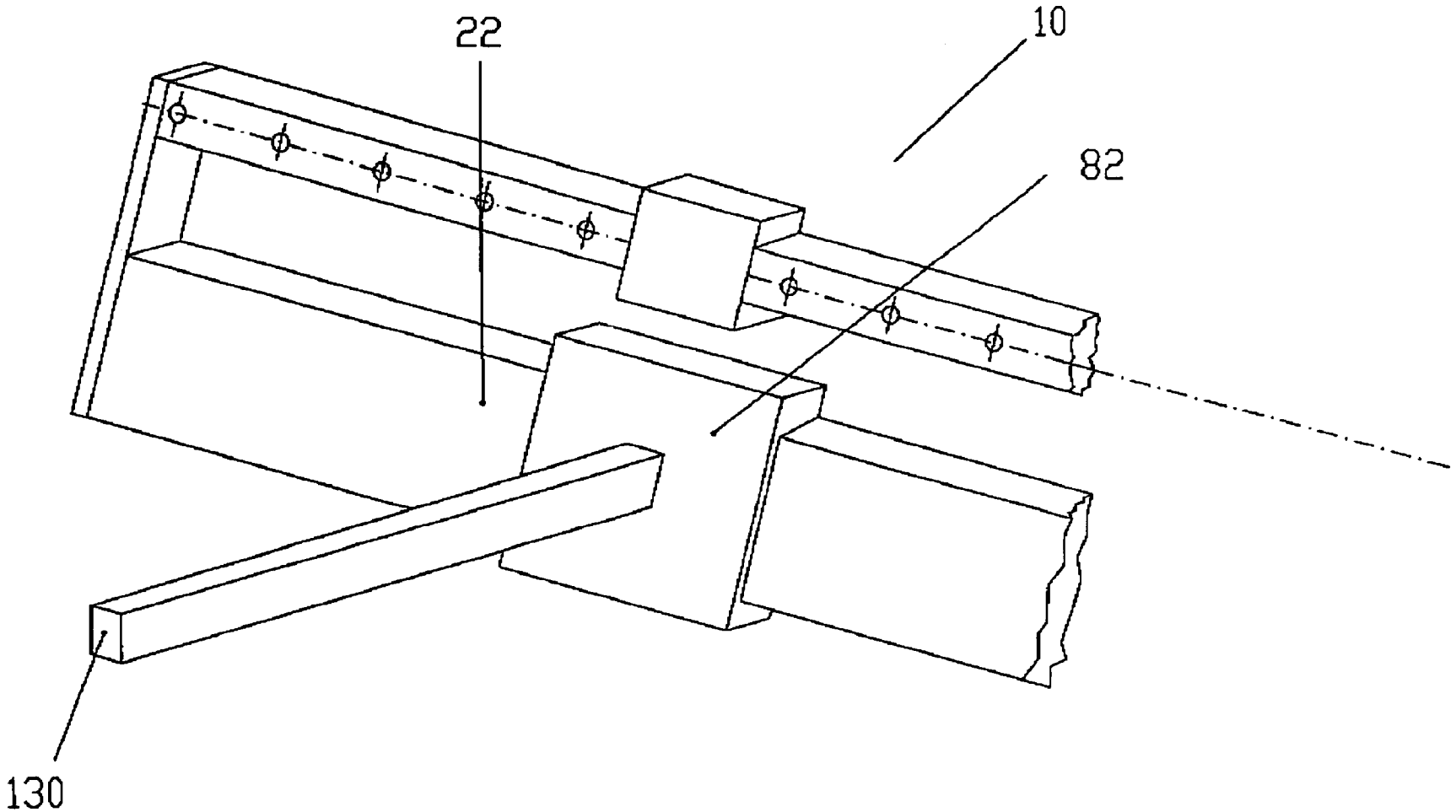
FIG. 12 is a close-up illustrating attachment of a post to the main carriage.

To further enhance the variety of weight training exercises that may be performed using the multi-function weight training apparatus 10 of the present invention, the multi-function weight training apparatus 10 may include a post 130 that extends substantially perpendicular from the main carriage 82, as illustrated in FIG. 12. By applying a force to the post 130 that is substantially aligned along the linear motion beam 22, the main carriage 82 is moved with respect to the linear motion beam 22. Moving the main carriage 82 with respect to the linear motion beam 22 thereby causes the weight carriage 60 to be lifted. The post 130 is particularly suited for use when performing weight training exercises that utilize a linear motion such as a bench press.

Figure 13:
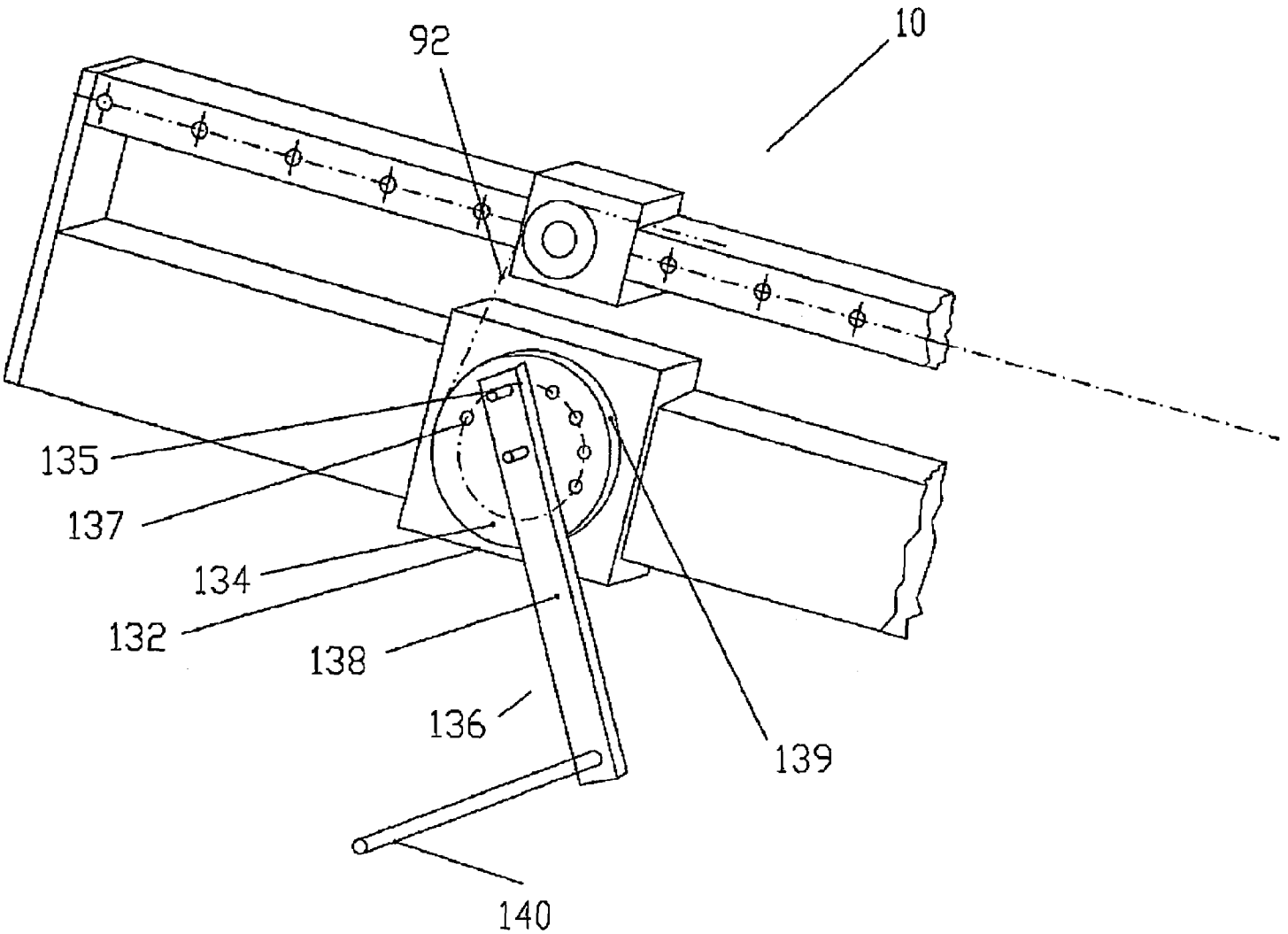
FIG. 13 is a close-up view illustrating attachment of a lever arm to the main carriage.
Figure 14:
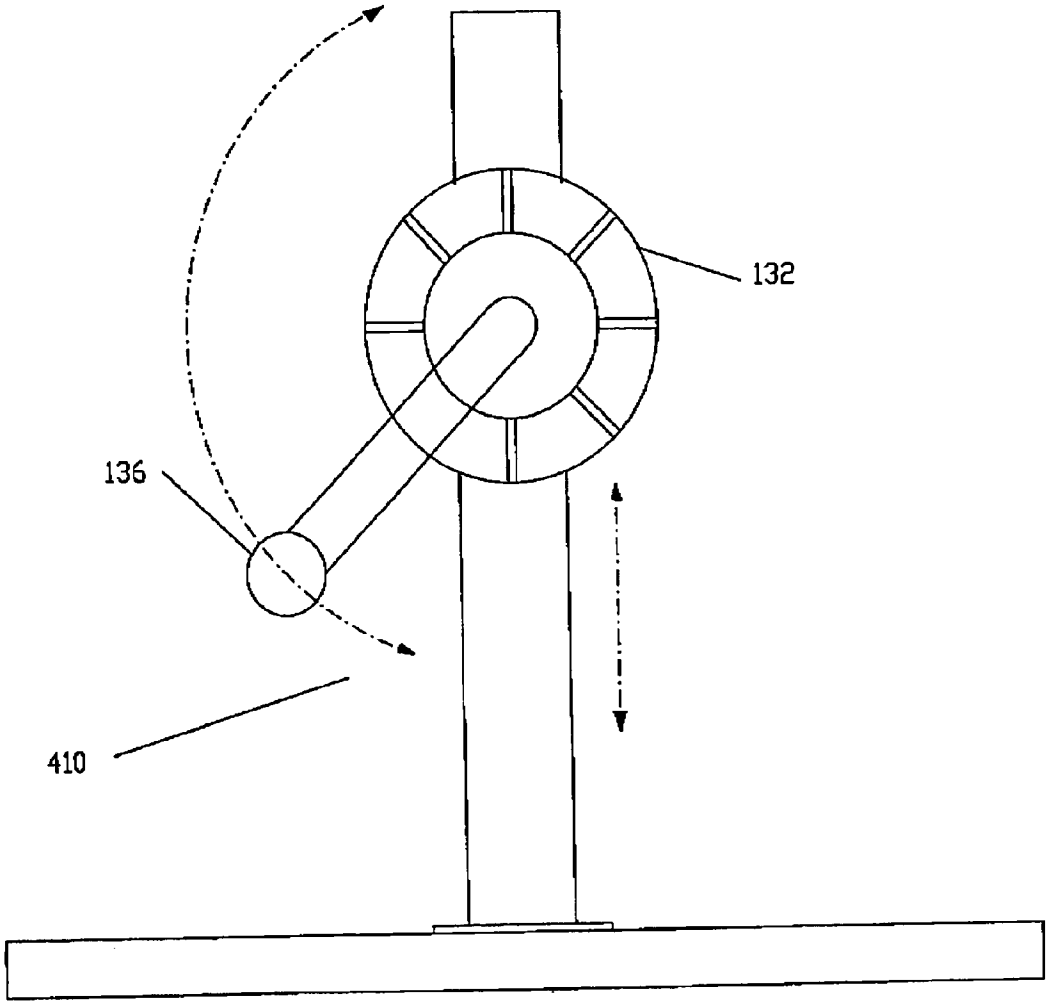
FIG. 14 is an illustration of adjusting the position of the lever arm with respect to the linear motion beam.
Figure 15:
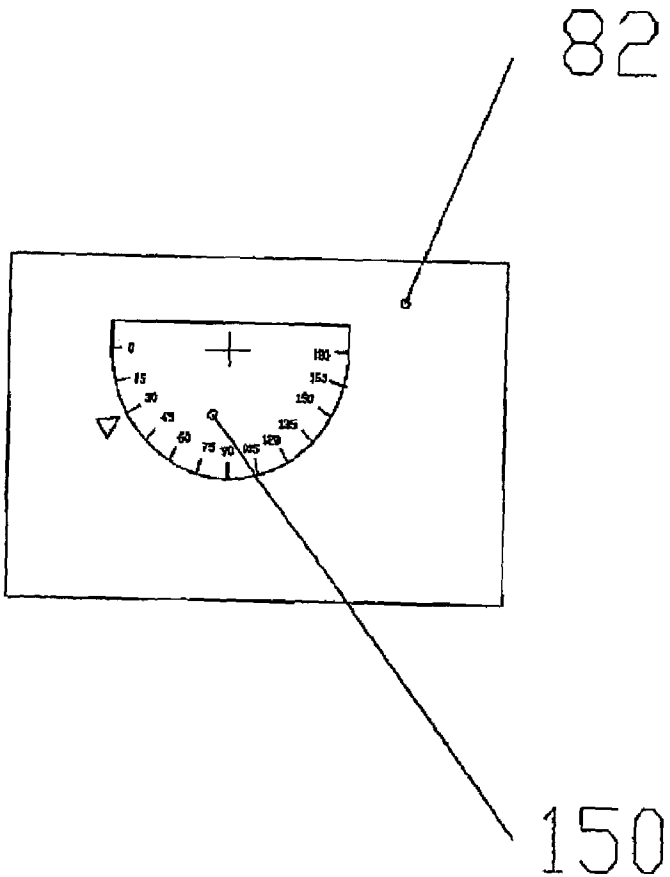
FIG. 15 is an illustration of attachment of a protractor to the linear motion beam.

In an alternative configuration, a lever arm attachment 132 is mounted with respect to the main carriage 82, as illustrated in FIGS. 13 and 14. The lever arm attachment 132 has a circular portion 134 with a channel 139 that extends around an outer surface thereof. As the lever arm attachment 132 is rotated with respect to the main carriage 82, the cable 92 at least partially seats in the channel 139. The lever arm attachment 132 is particularly suited for use with weight training exercises that utilize a rotating motion such as a leg extension.

An arm assembly 136 is rotatably attached to the circular portion 134. The arm assembly 136 has two sections 138, 140 that are oriented at an approximately perpendicular configuration. The section 140 opposite is engaged when performing the weight training exercise. To enhance the comfort of performing the weight training exercise, the section 140 is preferably covered with a foam layer.

A person of ordinary skill in the art will appreciate that the type of foam and the thickness of the foam is selected based upon the anticipated weights that are to be lifted with the multi-function weight training apparatus 10 to ensure comfort of the person using the multi-function weight training apparatus 10.

The arm assembly 136 includes a least one pin 135 extending therefrom that is adapted to seat in at least one of a series of apertures 137 on the circular portion 134. Changing the orientation of the arm assembly 126 with respect to the circular portion 122 enables the multi-function weight training apparatus 10 to be configured for performing particular exercises.

To facilitate performing various exercises in an easily repeatable configuration, the main carriage 82 preferably has a protractor 150 rotatably mounted thereto. As the main carriage 82 is pivoted, the protractor 150 rotates with respect to the main section by gravity.

In operation, a desired amount of weight plates 58 is placed on the weight carriage. The hand crank wheel 74 is then rotated to turn the linear motion beam to a desired orientation for performing the weight training exercise.

Next, the resistance adjusting carriage 84 is positioned along the secondary post 86 for the desired weight training exercise. For pushing exercises, the resistance adjusting carriage 84 is moved closer to the location where the user will be standing. For pulling exercises, the resistance adjusting carriage 84 is moved away from the location where the user will be standing. The post 130 is next attached to the main carriage 82.

Thereafter, the user urges the post 130 to move along the main section 80. This movement causes the loose end of the cable 92 to be pulled through the resistance adjusting carriage 84. Pulling of the cable 92 causes the weight carriage 60 to be raised to exercise the muscles of the person using the weight training apparatus 10. Because the linear motion beam 22 is aligned along the direction in which the post 130 is being moved, the user is able to easily perform the exercise over a broad range of the desired muscle group's range of motion.

When the user desires to perform a different exercise on the multi-function exercise device 10, the orientation of the linear motion beam 22, the position of the resistance adjusting carriage 84, the weight plates 58 and the post 130 may be readily changed by the user so that the user can perform exercises that are designed to strengthen another group of muscles. The multi-function exercise device 10 thereby obviates the need to purchase a number of different exercising devices for exercising the various muscles groups on the human body.

Figure 16:
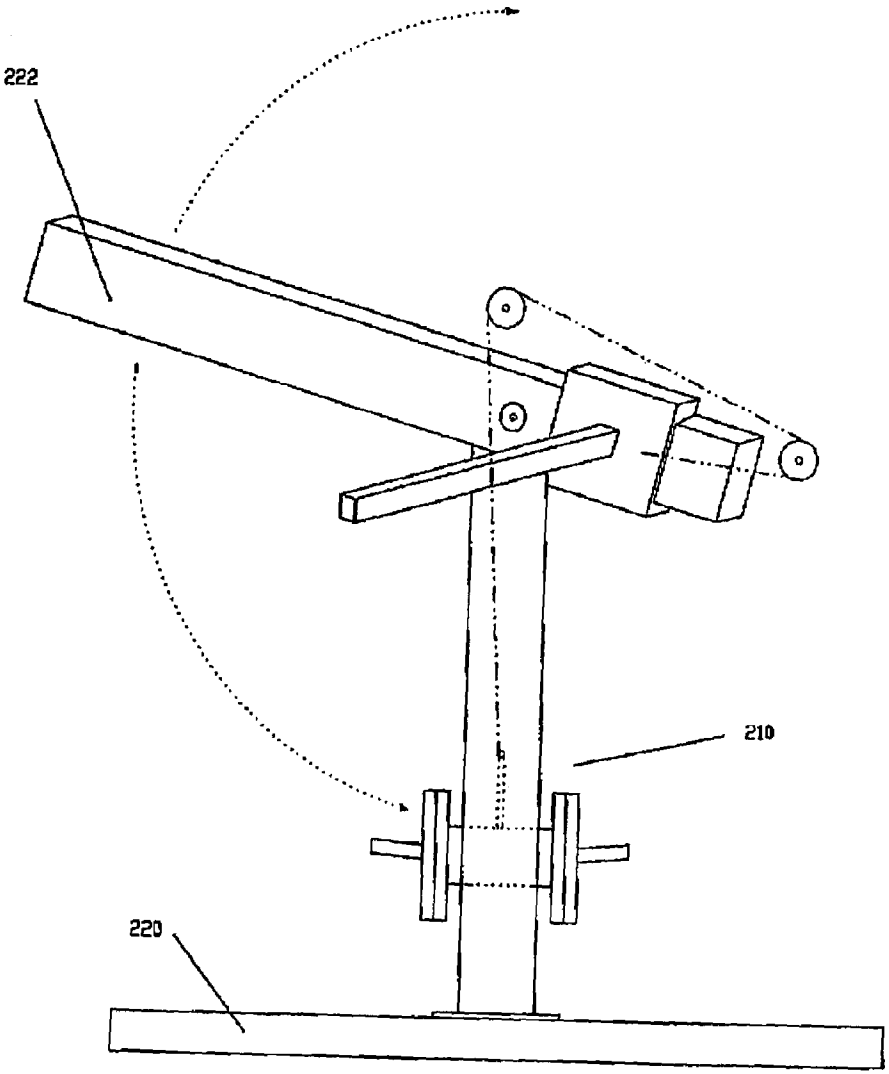
FIG. 16 is a side view of an alternative embodiment of the multi-function weight training apparatus for push-type exercises.
Figure 17:
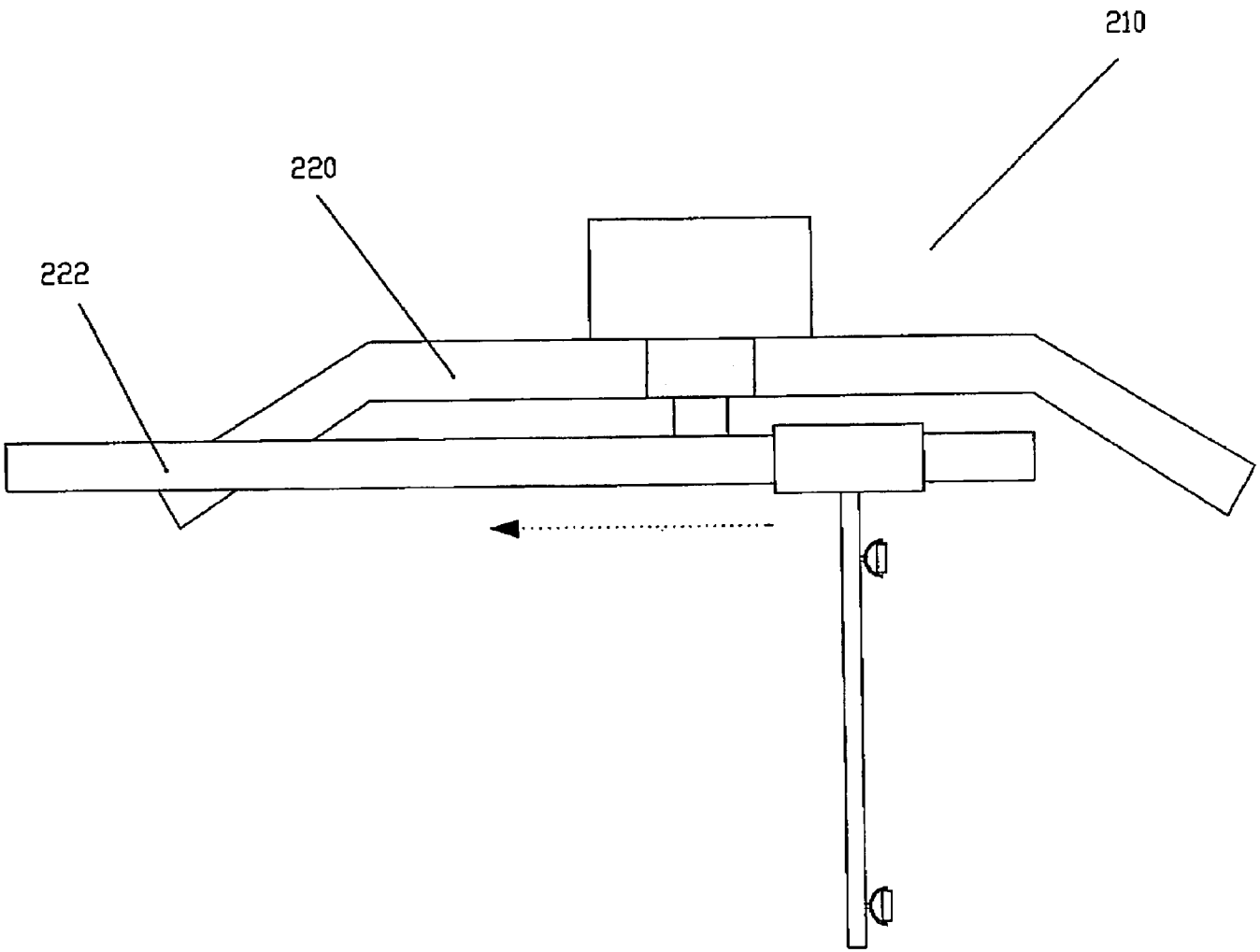
FIG. 17 is a top view of the multi-function weight training apparatus for push-type exercises.

It is also possible to configure the multi-function weight training apparatus 210 so that the apparatus is only suitable for performing push-type exercises, as illustrated in FIGS. 16 and 17. Configuring the multi-function weight training apparatus 210 in this manner reduces the complexity of the multi-function weight training apparatus 210 while retaining the ability of the linear motion beam 222 to rotate with respect to a support base 220 for performing a variety of push-type exercises.

Figure 18:
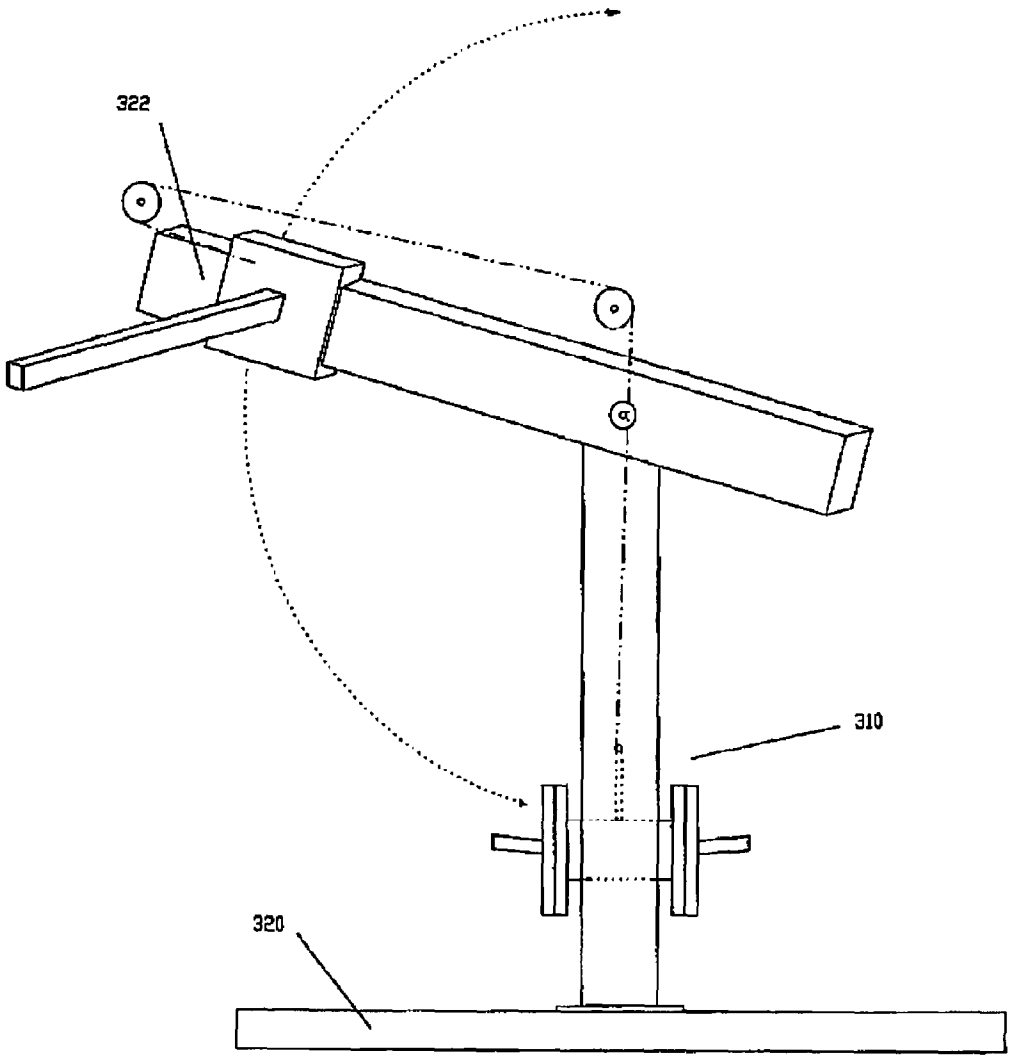
FIG. 18 is a side view of an alternative embodiment of the multi-function weight training apparatus for pull-type exercises.
Figure 19:
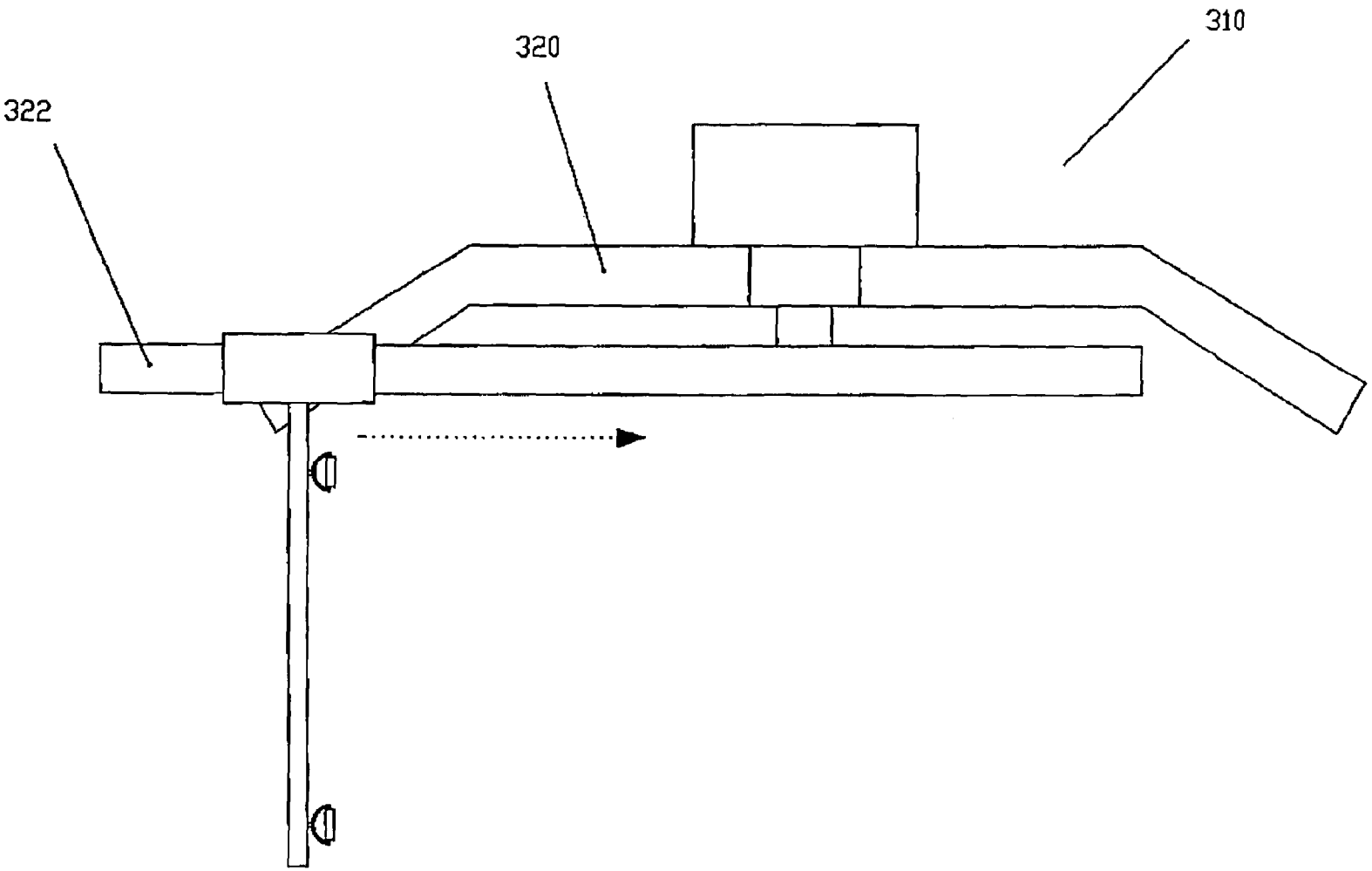
FIG. 19 is a top view of the multi-function weight training apparatus for pull-type exercises.

Similarly, it is also possible to configure the multi-function weight training apparatus 310 so that the apparatus is only suitable for performing pull-type exercises, as illustrated in FIGS. 18 and 19. Configuring the multi-function weight training apparatus 310 in this manner reduces the complexity of the multi-function weight training apparatus 310 while retaining the ability of the linear motion beam 322 to rotate with respect to a support base 320 for performing a variety of pull-type exercises.

Figure 20:
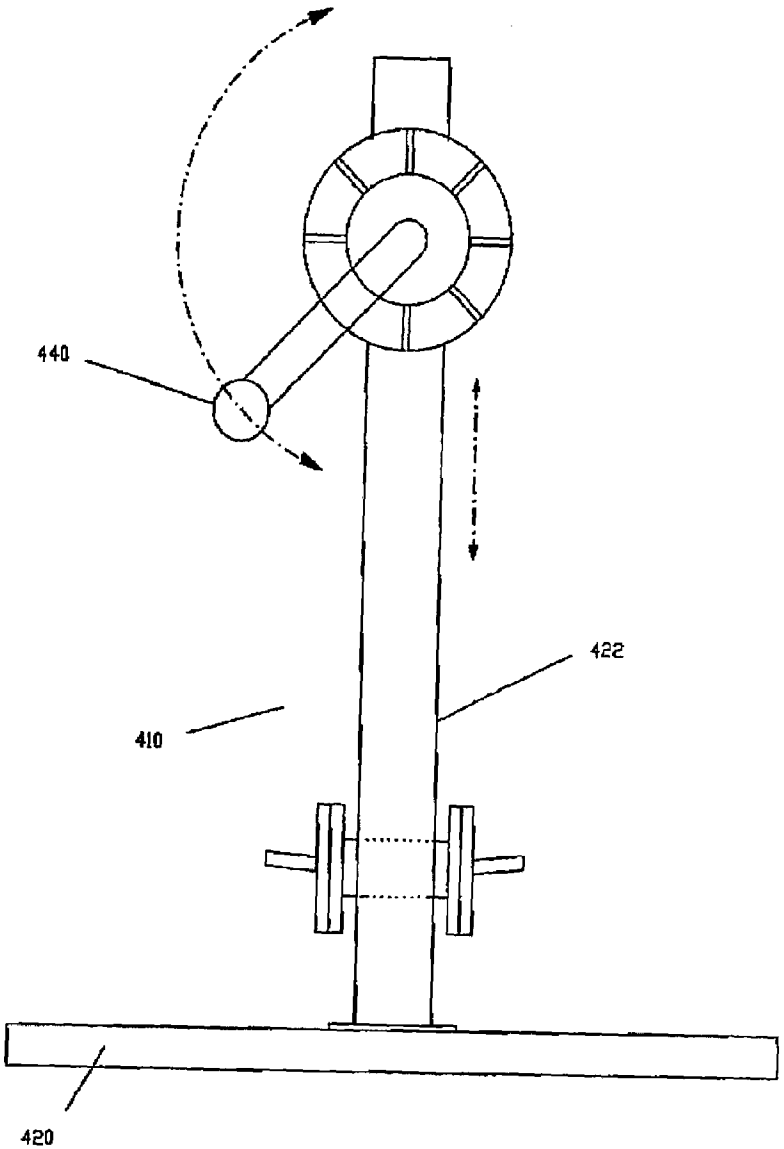
FIG. 20 is a side view of an alternative embodiment of the multi-function weight training apparatus for lever arm exercises.
Figure 21:
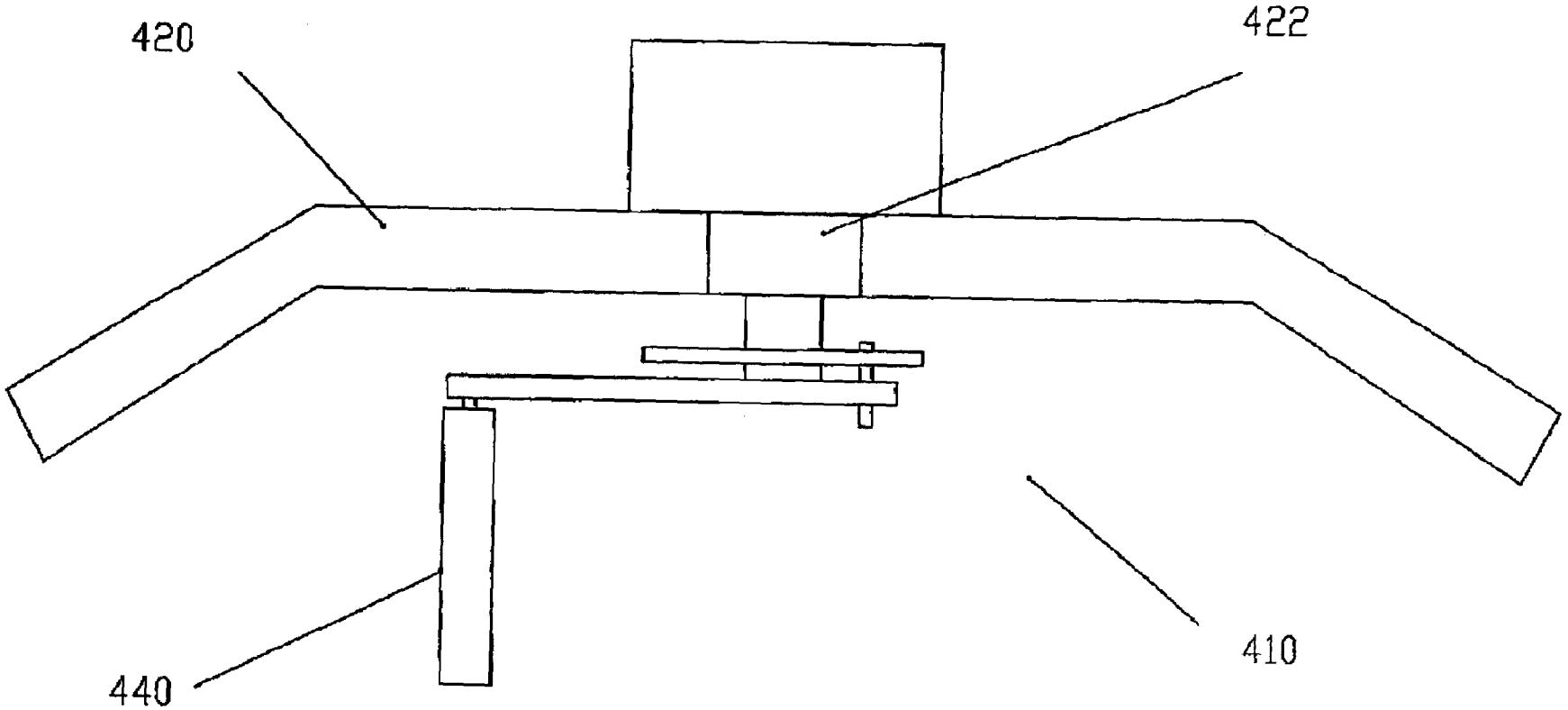
FIG. 21 is a top view of the multi-function weight training apparatus for lever arm exercises.

It is further possible to configure the multi-function weight training apparatus for use only with the rotating lever arm 440, as illustrated in FIGS. 20 and 21. Configuring the multi-function weight training apparatus 410 in this manner reduces the complexity of the multi-function weight training apparatus 410 while retaining the ability of the linear motion beam 422 to pivot with respect to a support base 420 for performing a variety of rotation-type exercises.

Figure 22:
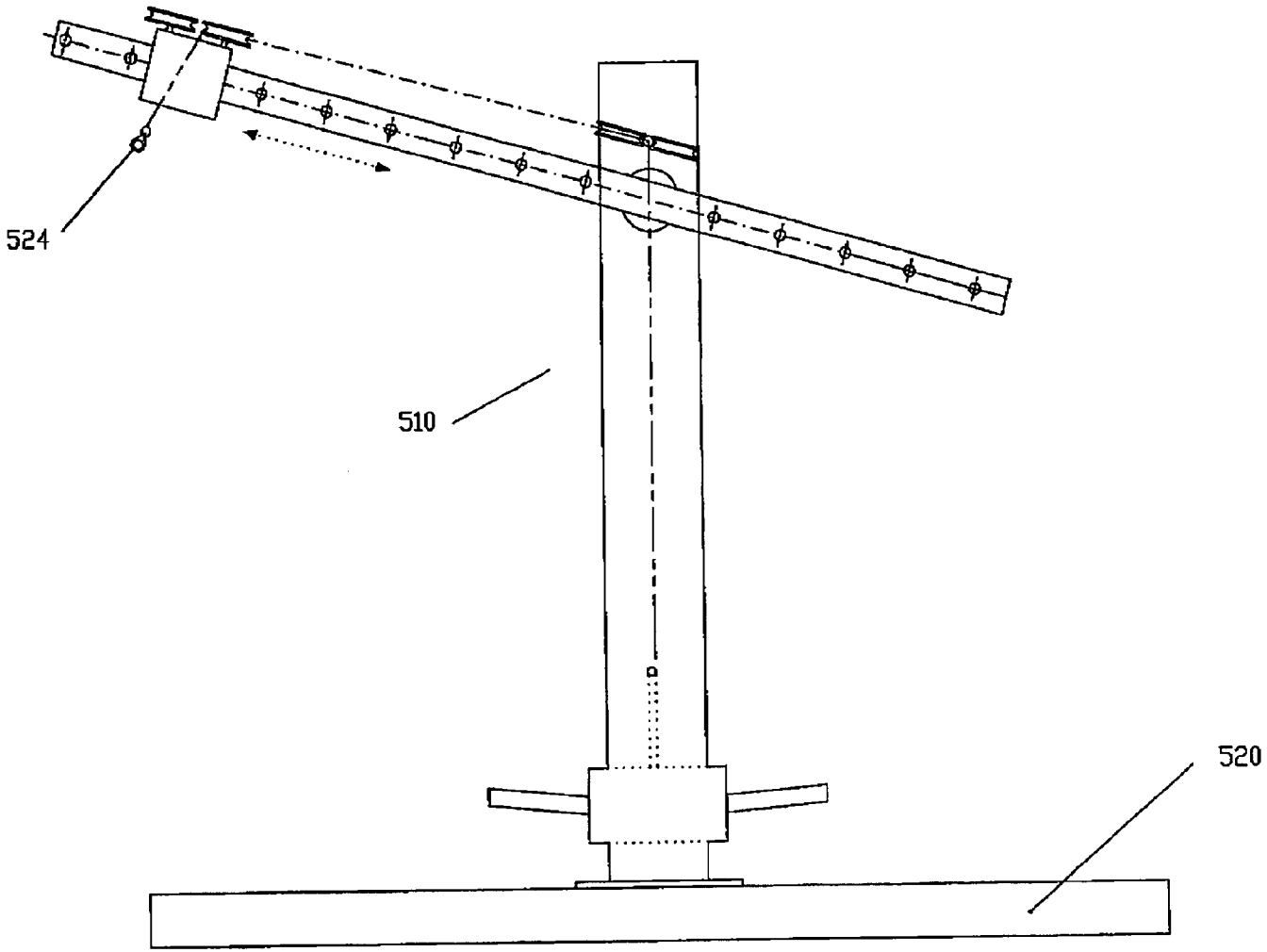
FIG. 22 is a side view of an alternative embodiment of the multi-function weight training apparatus for exercises that use handles or other attachments.

It is further possible to configure the multi-function weight training apparatus for use only with a free cable end 524, as illustrated in FIG. 22. A handle or other attachment (not shown) is removably attached to the free cable end depending on the desired exercise. Configuring the multi-function weight training apparatus 510 in this manner reduces the complexity of the multi-function weight training apparatus 510 while retaining the ability of the linear motion beam 522 to pivot with respect to a support base 520 for performing a variety of exercises.

It is also contemplated that the concepts of the present invention can be used where the resistance is incorporated within the linear motion beam. In this configuration, the resistance would preferably be a stretchable band, hydraulic fluid or a compressed gas. By incorporating the resistance in the linear motion beam, the overall complexity of the multi-function weight training apparatus is reduced while retaining the ability to perform a variety of exercises. Such a version of the multi-function weight training apparatus is particularly suited for home use.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. An exercise apparatus comprising;

a support base;

a beam supported for rotation relative to the support base about a rotation axis at least between a generally horizontal orientation and a generally vertical orientation;

an adjustable force resistance mechanism supported by the support base; and a main carriage supported by the beam and configured to move linearly along said beam from a starting position, the main carriage being linked to the force resistance mechanism, whereby linear movement of said main carriage from the starting position along said beam results in resistance being provided by the adjustable force resistance mechanism against said movement, wherein a magnitude of the resistance provided by the adjustable force resistance mechanism against said movement of said main carriage, and not including any resistance offered by the main carriage itself, is independent of a rotational orientation of said beam relative to the support base.

2. The exercise apparatus of claim 1, wherein the starting position of the main carriage is adjustable along the beam.

3. The exercise apparatus of claim 1, further comprising a cable and pulley assembly connecting the main carriage with the force resistance mechanism.

4. The exercise apparatus of claim 1, further comprising an indicator arrangement configured to indicate a relative rotational position of the beam with respect to the support base.

5. The exercise apparatus of claim 1, wherein the force resistance mechanism comprises a weight carriage for carrying one or more weights.

6. The exercise apparatus of claim 1, further comprising one or more urethane rollers supporting the main carriage on the beam.

7. The exercise apparatus of claim 1, wherein the support base comprises a central member and first and second end members connected to the central member, wherein the first and second end members are angled with respect to one another such that a distance between forward ends of the first and second end members is greater than a distance between rearward ends of the first and second end members.

8. The exercise apparatus of claim 1, wherein the force resistance mechanism comprises a weight carriage movable in a vertical direction regardless of the rotational orientation of said beam relative to the support base.

9. A multi-function weight training apparatus comprising:

a support base;

a linear motion beam rotatably supported by the support base;

a main carriage supported by the linear motion beam;

an adjustment carriage carried by the linear motion beam for adjusting a starting position of the main carriage, wherein the adjustment carriage is selectively positionable along said linear motion beam;

a weight carriage for providing resistance against movement of the main carriage; and a flexible link operably connecting the weight carriage to the main carriage.

10. The multi-function weight training apparatus of claim 9, wherein the support base has a bottom section and a main post that extends from the bottom section, and wherein the linear motion beam is attached to the main post opposite the bottom section.

11. The multi-function weight training apparatus of claim 9, wherein the linear motion beam has a main section and a secondary posts that are oriented substantially parallel to each other, wherein the main carriage is movable along the main section and wherein the adjustment carriage is movable along the secondary post.

12. The multi-function weight training apparatus of claim 11, wherein the secondary post has a plurality of apertures formed therein, and wherein the apertures are adapted to receive a pin on the adjustment carriage for positioning the adjustment carriage at discrete locations on the secondary post.

13. The multi-function weight training apparatus of claim 9, wherein the adjustment carriage has at least one pulley operably attached thereto, and wherein the pulley has a concaved outer surface that is adapted to receive the cable.

14. The multi-function weight training apparatus of claim 9, further comprising a device for controlling rotation of the linear motion beam.

15. The multi-function weight training apparatus of claim 14, wherein the rotation-controlling device comprises a worm gear drive attached to the linear motion beam and a hand crank attached to the support base.

16. An exercise apparatus comprising:

a support base;

a beam rotatably supported by the support base;

a force resistance mechanism supported by the support base;

a main carriage supported by the beam and configured to move linearly along said beam from a starting position, the main carriage being linked to the force resistance mechanism, whereby linear movement of said main carriage from the starting position along said beam results in resistance being provided against said movement;

a cable and pulley assembly connecting the main carriage with the force resistance mechanism; and further comprising a secondary carriage carried by the beam and adjustable to one of a plurality of positions along the beam, and where the cable and pulley assembly comprises a cable having a first end connectable to the main carriage, a second end fixed to the secondary carriage, and an intermediate portion engaging at least one pulley carried by said secondary carriage, wherein adjustment of said secondary carriage along said beam changes the starting position of said main carriage on said beam.

17. The exercise apparatus of claim 16, wherein the cable and pulley assembly comprises a pair of pulleys carried by the secondary carriage and defining a space therebetween for receiving the cable, whereby the main carriage is moveable in either direction along the beam from the starting position against a resistance provided by said force resistance mechanism.

18. The exercise apparatus of claim 16, wherein the first end of the cable is detachable from the main carriage, wherein movement of said first end of said cable results in resistance being provided against said movement.

19. The exercise apparatus of claim 16, further comprising one or more urethane rollers supporting the secondary carriage on the beam.

20. An exercise apparatus comprising;

a support base;

a beam supported for rotation relative to the support base about a rotation axis;

an adjustable force resistance mechanism supported by the support base; and a main carriage supported by the beam and configured to move linearly along said beam from a starting position, the main carriage being linked to the force resistance mechanism, whereby linear movement of said main carriage from the starting position along said beam results in resistance being provided by the adjustable force resistance mechanism against said movement, wherein a magnitude of the resistance provided by the adjustable force resistance mechanism against said movement of said main carriage, and not including any resistance offered by the main carriage itself, is independent of a rotational orientation of said beam relative to the support base;

wherein the main carriage is configured to move initially in either direction from the starting position to overcome resistance in either push or pull motions.

21. The exercise apparatus of claim 20, wherein the force resistance mechanism comprises a weight carriage movable in a vertical direction regardless of the rotational orientation of said beam relative to the support base.

22. An exercise apparatus comprising;

a support base;

a beam supported for rotation relative to the support base about a rotation axis;

an adjustable force resistance mechanism supported by the support base; and a main carriage supported by the beam and configured to move linearly along said beam from a starting position, the main carriage being linked to the force resistance mechanism, whereby linear movement of said main carriage from the starting position along said beam results in resistance being provided by the adjustable force resistance mechanism against said movement, wherein a magnitude of the resistance provided by the adjustable force resistance mechanism against said movement of said main carriage, and not including any resistance offered by the main carriage itself, is independent of a rotational orientation of said beam relative to the support base.

23. The exercise apparatus of claim 22, wherein the force resistance mechanism comprises a weight carriage movable in a vertical direction regardless of the rotational orientation of said beam relative to the support base.

24. An exercise apparatus comprising:

a support base;

a beam rotatably supported by the support base;

a force resistance mechanism supported by the support base;

a main carriage supported by the beam and configured to move linearly along said beam from a starting position, the main carriage being linked to the force resistance mechanism, whereby linear movement of said main carriage from the starting position along said beam results in resistance being provided against said movement; and a counterweight connected for movement with the main carriage to balance the weight of said main carriage relative to an axis of rotation of the beam.

25. An exercise apparatus comprising:

a support base;

a beam rotatably supported by the support base;

a force resistance mechanism supported by the support base;

a main carriage supported by the beam and configured to move linearly along said beam from a starting position, the main carriage being linked to the force resistance mechanism, whereby linear movement of said main carriage from the starting position along said beam results in resistance being provided against said movement;

an indicator arrangement configured to indicate a relative rotational position of the beam with respect to the support base, wherein the indicator arrangement comprises a first member rotatably supported by the beam, the first member being retained in a substantially stationary position by gravity and including a plurality of markings thereon, said indicator arrangement further comprising a reference point fixed for rotation with said beam, the reference point cooperating with the plurality of markings of said first member to indicate a relative rotational position of said beam with respect to the support base.

* * * * *